US005181718A

United States Patent [19]

Valentine

[11] Patent Number: 5,181,718

[45] Date of Patent: Jan. 26, 1993

[54] POOL STICK APPARATUS

[76] Inventor: Douglas H. Valentine, P.O. Box 261 Redondo La., Templeton, Calif. 93465

[21] Appl. No.: 802,543

[22] Filed: Dec. 5, 1991

[51] Int. Cl.[5] ..... A63D 15/08

[52] U.S. Cl. ..... 273/69; 124/16; 124/20.2

[58] Field of Search ..... 273/68-70; 124/16, 20.2

[56] References Cited

U.S. PATENT DOCUMENTS

| | | | |
|---|---|---|---|
| 1,182,530 | 5/1916 | Doane | 273/69 |
| 1,213,628 | 1/1917 | Gumaer | 273/69 |
| 1,218,373 | 3/1917 | Christie | 273/69 |
| 1,226,273 | 5/1917 | Moon | 273/69 |
| 1,695,120 | 12/1928 | Parent | 273/69 |
| 2,462,526 | 2/1949 | McNair | 273/69 |
| 3,447,805 | 6/1969 | Baley, Jr. et al. | 273/69 |
| 3,834,706 | 9/1974 | Leonhart | 273/69 |
| 3,858,882 | 1/1975 | Fox et al. | 273/69 |
| 4,526,370 | 7/1985 | Martellacci | 273/69 |
| 4,634,123 | 1/1987 | Cowan et al. | 273/69 |

FOREIGN PATENT DOCUMENTS

| | | | |
|---|---|---|---|
| 137075 | 5/1950 | Australia | 273/69 |
| 7560 | 2/1879 | Fed. Rep. of Germany | 273/69 |
| 375104 | 9/1939 | Italy | 273/69 |

*Primary Examiner*—Mark Graham

*Attorney, Agent, or Firm*—Hugh E. Smith

[57] ABSTRACT

A pool stick or cue is mounted in a biased relationship within a rifle stock, wherein a trigger releases a lug mounted to the cue interiorly of the stock to permit projection of the cue forwardly of the stock in a coaxially aligned relationship for impact with a pool ball. A modification of the invention includes a fiber optic cable directed through the forward translucent sight to enhance visual alignment of a rear sight relative to the forward sight, as well as a fiber optic cable axially parallel at its forward end to the pool cue and the associated cylindrical bore within the rifle stock.

5 Claims, 4 Drawing Sheets

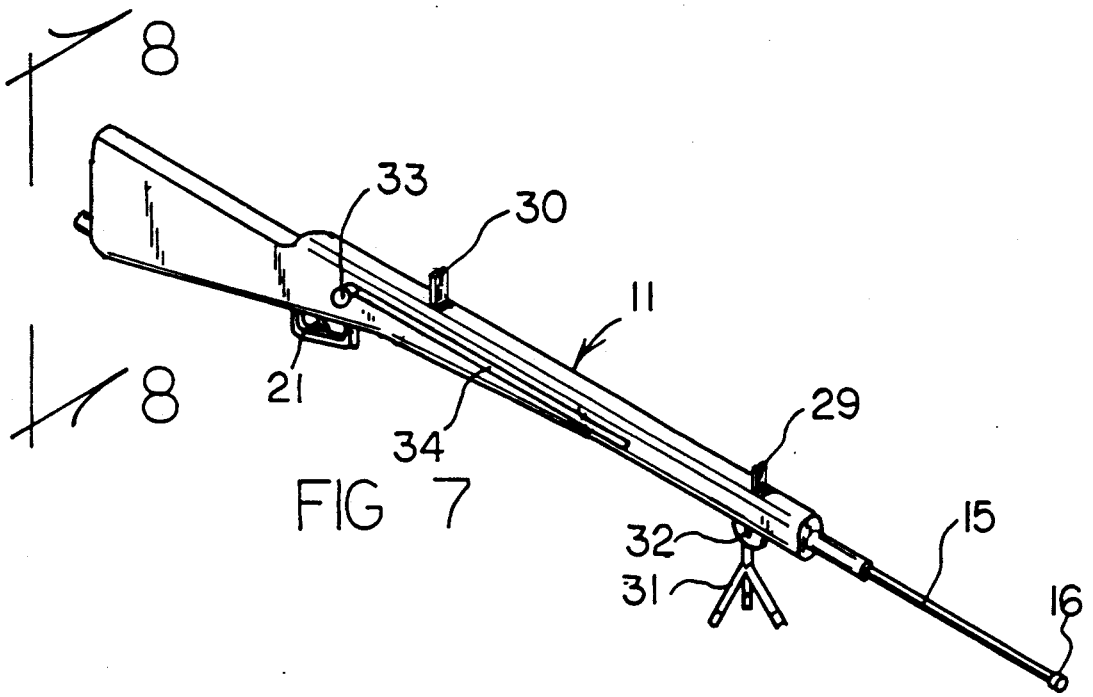
FIG 7
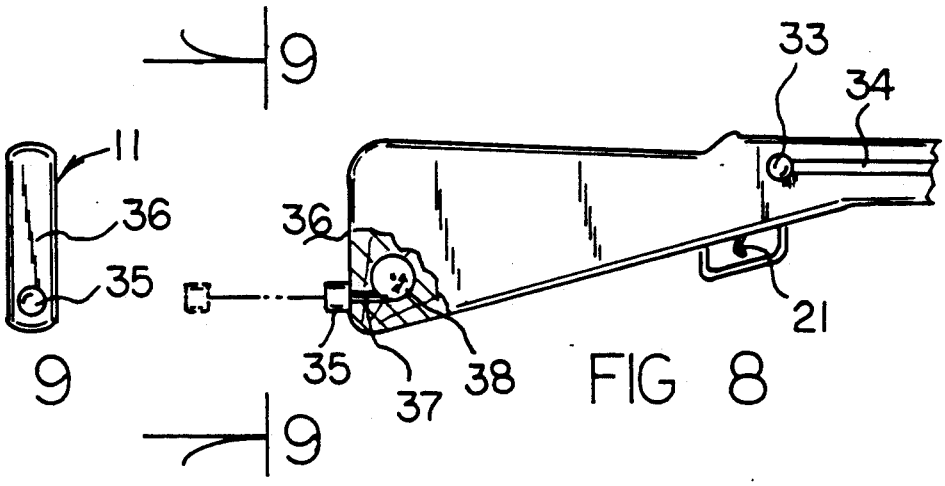
FIG 9
FIG 8

POOL STICK APPARATUS

BACKGROUND OF THE INVENTION

1. Field of the Invention

The field of invention relates to pool cue apparatus, and more particularly pertains to a new and improved pool stick apparatus wherein the same is arranged for actuation and projection of a pool stick relative to a rifle stock.

2. Description of the Prior Art

Various spring actuated billiard cues have been utilized in the prior art, and such are exemplified in the U.S. Pat. Nos. 3,495,826 to Mizgala; 4,134,588 to Di Luzio; 3,711,093 to Evans; and 3,447,805 to Baley, Jr. The prior art structure has heretofore, however, failed to set forth a conveniently aimed and operative organization to effect impact with an associated billiard ball and in this respect, the present invention substantially fulfills this need.

SUMMARY OF THE INVENTION

In view of the foregoing disadvantages inherent in the known types of pool stick apparatus now present in the prior art, the present invention provides a pool stick apparatus wherein the same is arranged to provide for a spring-biased billiard cue arranged for projection forwardly of an elongate rifle stock. As such, the general purpose of the present invention, which will be described subsequently in greater detail, is to provide a new and improved pool stick apparatus which has all the advantages of the prior art pool stick apparatus and none of the disadvantages.

To attain this, the present invention provides a pool stick or cue mounted in a biased relationship within a rifle stock, wherein a trigger releases a lug mounted to the cue interiorly of the stock to permit projection of the cue forwardly of the stock in a coaxially aligned relationship for impact with a pool ball. A modification of the invention includes a fiber optic cable directed through the forward translucent sight to enhance visual alignment of a rear sight relative to the forward sight, as well as a fiber optic cable axially parallel at its forward end to the pool cue and the associate cylindrical bore within the rifle stock.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and inproved pool stick apparatus which has all the advantages of the prior art pool stick apparatus and none of the disadvantages.

It is another object of the present invention to provide a new and improved pool stick apparatus which may be easily and efficiently manufactured and marketed.

It is a further object of the present invention to provide a new and improved pool stick apparatus which is of a durable and reliable construction.

An even further object of the present invention is to provide a new and improved pool stick apparatus which is susceptible of a low cost of manufacture with regard to both materials and labor, and which accordingly is then susceptible of low prices of sale to the consuming public, thereby making such pool stick apparatus economically available to the buying public.

Still yet another object of the present invention is to provide a new and improved pool stick apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the invention utilizing viewing sites and a chalking cup.

FIG. 8 is an orthographic view, taken along the lines 8—8 of FIG. 7 in the direction indicated by the arrows.

FIG. 9 is an orthographic view, taken along the lines 9—9 of FIG. 8 in the direction indicated by the arrows.

DESCRIPTION OF THE PREFERRED EMBODIMENT

Figure 1:
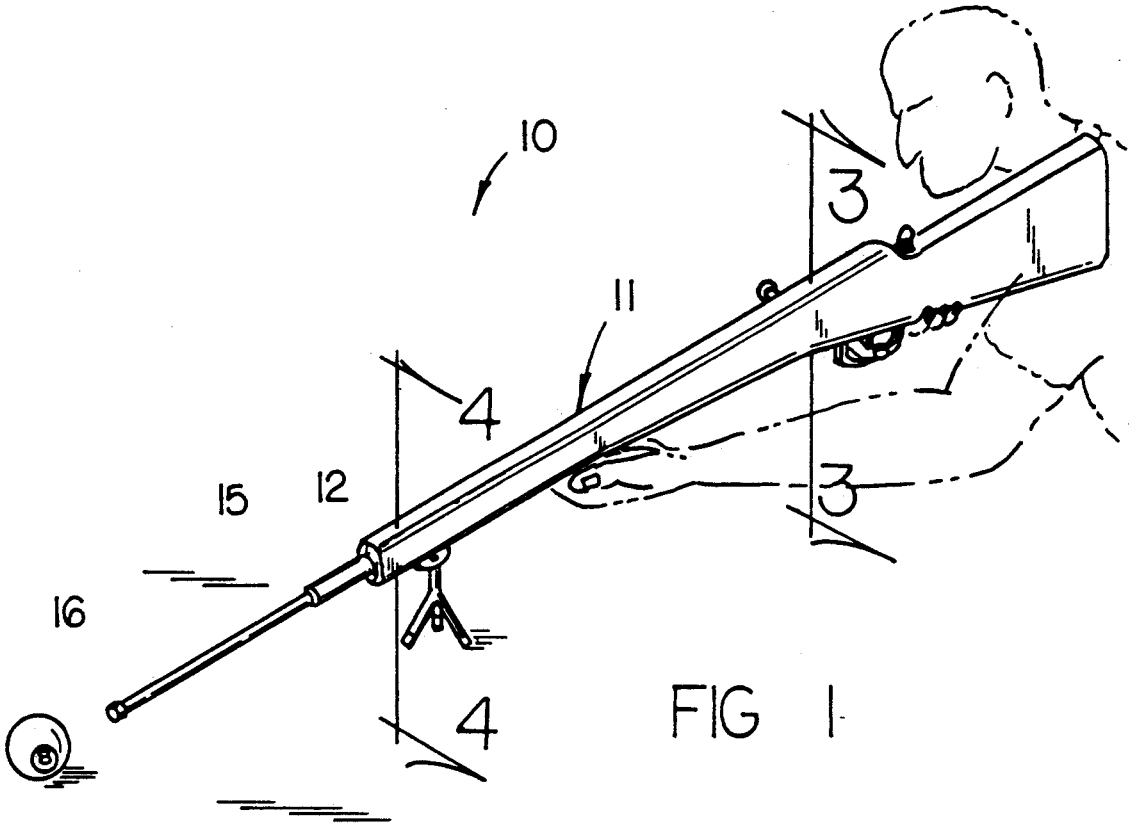
FIG. 1 is an isometric illustration of the instant invention.
Figure 2:
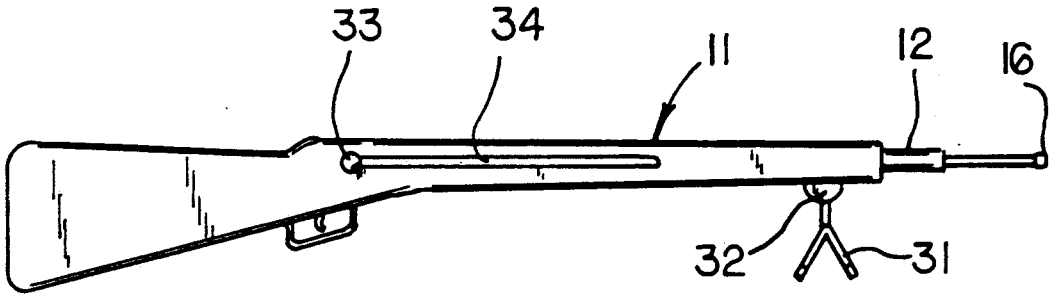
FIG. 2 is an orthographic side view of the instant invention.

With reference now to the drawings, and in particular to FIGS. 1 to 12 thereof, a new and improved pool stick apparatus embodying the principles and concepts of the present invention and generally designated by the reference numerals 10 and 10*a* will be described.

Figure 3:
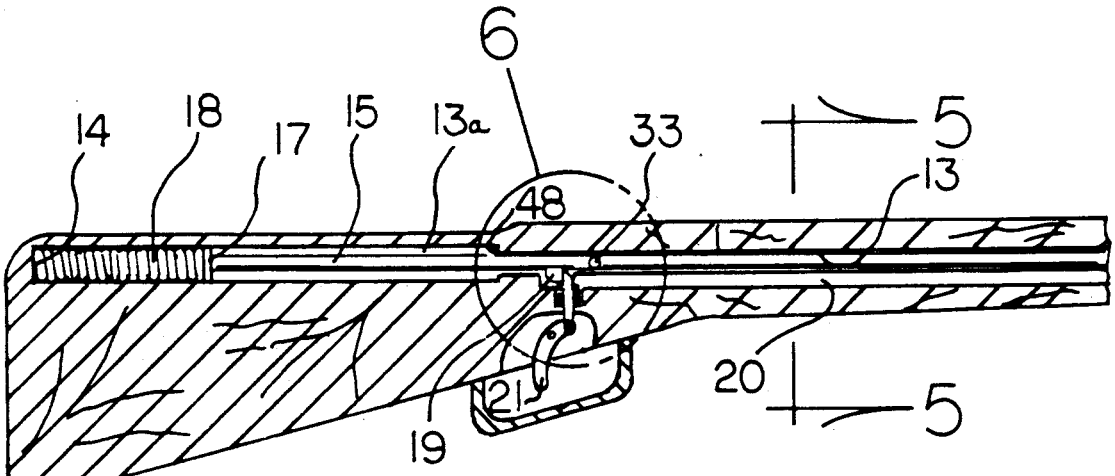
FIG. 3 is an orthographic view, taken along the lines 3—3 of FIG. 1 in the direction indicated by the arrows.
Figure 5:
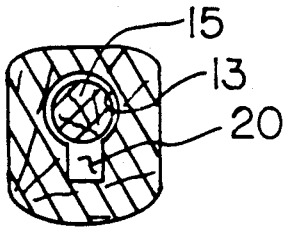
FIG. 5 is an orthographic view, taken along the lines 5—5 of FIG. 3 in the direction indicated by the arrows.
Figure 4:
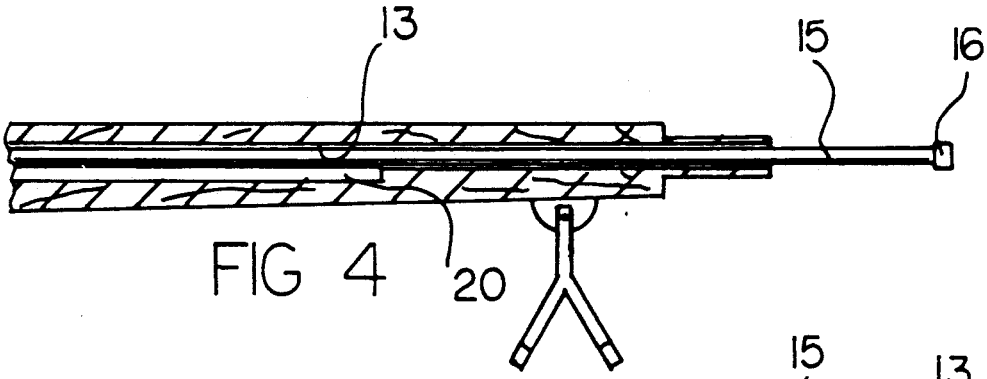
FIG. 4 is an orthographic view, taken along the lines 4—4 of FIG. 1 in the direction indicated by the arrows.
Figure 6:
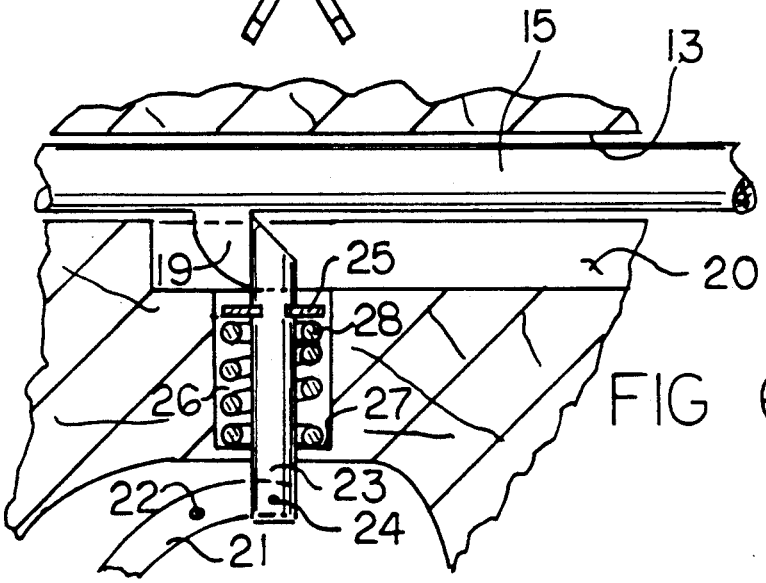
FIG. 6 is an enlarged orthographic view of section 6, as set forth in FIG. 3.

More specifically, the pool stick apparatus 10 of the instant invention essentially comprises an elongate rifle stock 11 having a front end wall and a rear end wall and including a cylindrical first bore 13 directed longitudinally of the rifle stock in cylindrical alignment with a second rifle bore 13*a* that terminates in a cylindrical bore rear wall 14 (see FIG. 3). A cylindrical guide bushing 12 coaxially aligned with the first and second bores 13 and 13*a* projects forwardly of and longitudinally relative to the rifle stock 11. A cylindrical cue rod 15 is slidably mounted within the first and second bores 13 and 13*a* projecting forwardly of the bushing 12 terminating in a forward tip 16. A cue rod rear plate 17 fixedly and orthogonally mounted to a rear distal end of the cue rod 15 is positioned within the cylindrical second bore 13*a* that is defined by a second diameter greater than the first diameter defined by the first bore 13 to arrest movement of the rear plate 17 within the second bore 13*a* and limit the movement of the rear plate 17 and the associated cue rod 15 the distance defined between the cylindrical bore rear wall 14 and the front wall 48 (see FIG. 3). An actuator spring 18 is captured between the cue rod rear plate 17 and the cylindrical second bore rear wall 14. A cue rod lug 19 fixedly mounted to the cue rod within the first bore 13 extends radially and exteriorly of the cue rod. A plurality of such cue rod lugs 19 may be mounted to the cue rod at spaced intervals along the cue rod, but wherein the purposes of illustration only one such lug 19 is illustrated. A key way slot 20 contiguous with and in communication with the first bore 13 slidably receives the lug 19 therealong. The lug 19 is, along with the spring 18, captured in a position rearwardly of a trigger 21 by a latch pin 23 pivotally mounted to the trigger 21 about a latch pin axle 24 within and forward of the pivot axle of the trigger as the latch pin 23 extends orthogonally relative to the cue rod 15 and is arranged for reception against a forward surface of the lug 19. The trigger 21 is pivotally mounted about a pivot axle 22, whereupon pivotment of the trigger 21 about the pivot axle 22 effects downward sliding translation of the latch pin 23 to remove the latch pin relative to the lug 19. The latch pin includes a collar 25 mounted to the latch pin, and the latch pin as illustrated is positioned within a latch pin well that includes a well floor 27. A latch pin spring accordingly is captured between the collar 25 and the floor 27 to normally bias the latch pin in a raised orientation, as illustrated in FIG. 6.

Figure 10:
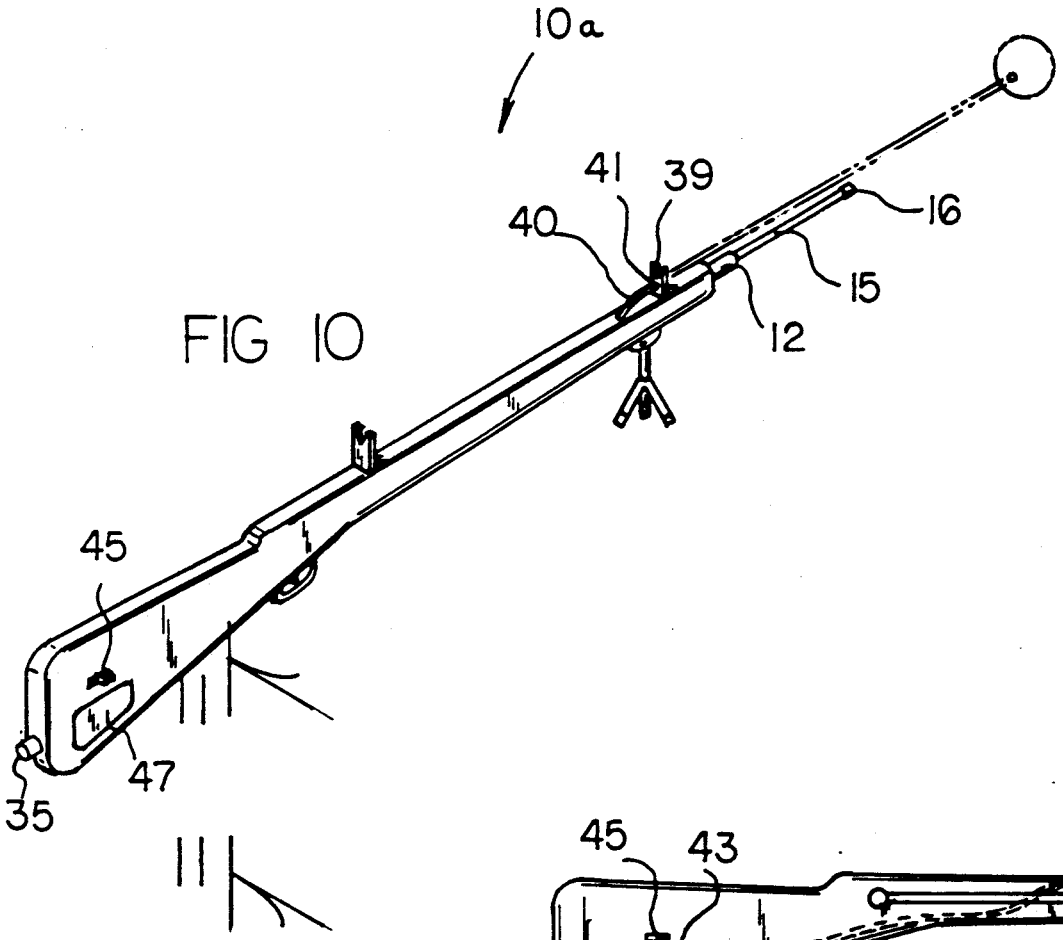
FIG. 10 is an isometric illustration of a modification of the invention.

The FIGS. 7 and 10 illustrate the use of a front sight 29 in cooperation with a rear sight 30 mounted to a top surface of the rifle stock, as well as the use of a tripod 31, mounted to the rifle stock 11 at a bottom surface thereof about a tripod pivot 32. It should be further noted that the cue rod 15 includes a cue rod bolt 33 extending radially and exteriorly of the cue rod, and wherein the cue rod bolt 33 is slidably mounted within a slot 34 through the stock 11.

A chalk cup 35 is mounted to a rifle stock end wall plate 36 in abutment therewithin, wherein a tether line 37 mounted to the chalk cup 35 is positioned within the rifle stock 11 and wound about a recoil housing spool 38 within the rifle stock 11 adjacent the end wall plate 36 to normally bias the chalk cup in abutment against the end wall plate 36, as illustrated.

Figure 11:
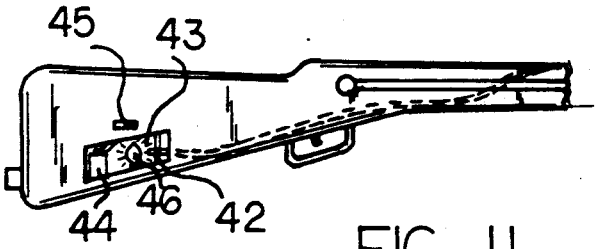
FIG. 11 is an othographic view, partially in section, along the lines 11—11 of FIG. 10 in the direction indicated by the arrows.
Figure 12:
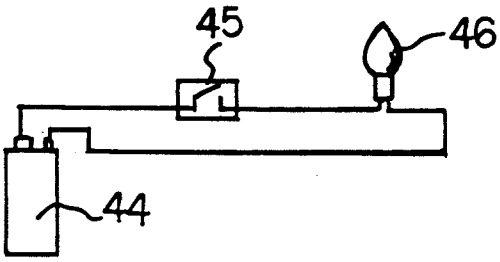
FIG. 12 is a diagrammatic illustration of the electrical circuitry utilized for illumination of the fiber optic cable of the instant invention.

The sight apparatus of the FIGS. 10–12 illustrates the use of a translucent front sight 39, wherein a fiber optic cable 40 is provided that includes a fiber optic cable forward end 41 positioned fixedly within the translucent front sight 39 to effect illumination thereof, and wherein the fiber optic cable forward end 41 is arranged in a axially parallel relationship relative to the cue rod 15 to enhance illumination and sighting of a target billiard ball, as illustrated in FIG. 10. An illumination cavity 43 is positioned within the stock 11 rearwardly of the trigger, to include a batter 44 operative through a switch 45 projecting through the rifle stock, wherein the illumination cavity 43 is positioned rearwardly of a cover plate 47 removably mounted relative to the rifle stock exterior surface, whereupon illumination of the illumination bulb 46 effects projection of illumination through the fiber optic cable 40 from the fiber optic cable rear end 42 into the translucent front sight 39, as described above.

As to the manner or usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to on skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Uniteds States is as follows:

1. A pool stick apparatus, comprising, an elongate rifle stock, the rifle stock including a front end wall and a rear end wall, the front end wall including a cylindrical guide bushing projecting forwardly of the front end wall, and a cylindrical first bore in communication with the cylindrical guide bushing coaxially aligned therewith, and a cylindrical second bore projecting rearwardly of the cylindrical first bore in communication therewith, wherein the cylindrical second bore is defined by a second diameter greater than first diameter defined by the first bore, and a cylindrical cue rod slidably mounted within the first bore and the second bore, and a rear plate fixedly and orthogonally mounted to a rear distal end of the cue rod, with the rear plate positioned within the second bore, the second bore including a second bore rear wall and a second bore front wall, and an actuator spring captured between the rear plate and the second bore rear wall, and the cue rod including a forward tip mounted to a forward distal end of the cue rod positioned exteriorly of the guide bushing, and a trigger pivotally mounted within a housing below the first bore, and a key way slot in contiguous communication with the first bore, and a cue rod lug fixedly mounted to the cue rod positioned within the key way slot, the trigger pivotally mounted about a pivot axle, the pivot axle pivotally mounted to the housing, and a latch pin, the latch pin including a latch pin axle, the latch pin axle mounted within the trigger forwardly of the pivot axle, and the latch pin slidably mounted within the housing orthogonally oriented relative to the cue rod, the latch pin arranged for engagement with the cue rod lug, whereupon pivoting of the trigger effects displacement of the latch pin relative to the cue rod lug permitting projection of the cue rod forwardly of the guide bushing.

2. An apparatus as set forth in claim 1 wherein the latch pin includes collar, and the latch pin is reciprocatable within a well within the housing, the well including a well floor, and a latch pin spring captured between the well floor and the latch pin collar.

3. An apparatus as set forth in claim 2 wherein the rifle stock includes a front sight and a rear sight mounted to a top surface of the rifle stock, and a tripod mounted to a bottom surface of the rifle stock below the front sight, and a cue rod bolt orthogonally and fixedly mounted to the cue rod extending exteriorly of the housing, the housing including a bolt slot and the cue rod bolt slidably mounted within the bolt slot.

4. An apparatus as set forth in claim 3 including a chalk cup, the chalk cup including a tether line mounted to chalk cup at a forward end of the tether line, and a rear of the tether line wound within a recoil housing spool contained within the rifle stock adjacent the rear end wall to normally bias the chalk cup against the rear end wall.

5. An apparatus as set forth in claim 4 wherein the front sight is translucent, and a fiber optic cable is mounted within the rifle stock, wherein the fiber optic cable includes a fiber optic cable forward end positioned contiguously within the translucent front sight, and wherein the forward end of the fiber optic cable is axially aligned parallel relative to the cylindrical first bore, and the fiber optic cable including a cable rear end, the fiber optic cable rear end positioned within an illumination cavity contained within a housing adjacent the rear end wall, the illumination cavity including a battery, and an illumination bulb contained within the cavity, and a switch in electrical communication with the battery and the illumination bulb, with the switch projecting through the rifle stock adjacent the illumination cavity, and actuation of the illumination bulb effects illumination through the fiber optic cable and the illumination of the translucent front sight, and a cover plate removably mounted relative to the illumination cavity in alignment with an exterior surface of the rifle stock.

* * * * *